US009388604B2

(12) United States Patent
Ferreira Sanchez et al.

(10) Patent No.: US 9,388,604 B2
(45) Date of Patent: Jul. 12, 2016

(54) TAB LOCK OPENING MECHANISM BY MEANS OF ELECTRONIC CLUTCH CYLINDERS

(71) Applicant: SALTO SYSTEMS, S.L., Oiartzun (Guipuzcoa) (ES)

(72) Inventors: Carlos Ferreira Sanchez, Oiartzun (ES); Ander Munoz Laguardia, Oiartzun (ES)

(73) Assignee: SALTO SYSTEMS, S.L., Oiartzun (Guipuzcoa) (ES)

( * ) Notice: Subject to any disclaimer, the term of this patent is extended or adjusted under 35 U.S.C. 154(b) by 175 days.

(21) Appl. No.: 14/078,642

(22) Filed: Nov. 13, 2013

(65) Prior Publication Data

US 2014/0138201 A1 May 22, 2014

(30) Foreign Application Priority Data

Nov. 19, 2012 (ES) ..... 201231790

(51) Int. Cl.
*E05B 15/00* (2006.01)
*E05B 47/06* (2006.01)
*E05B 63/04* (2006.01)

(52) U.S. Cl.
CPC ..... *E05B 15/00* (2013.01); *E05B 47/0642* (2013.01); *E05B 63/04* (2013.01)

(58) Field of Classification Search
CPC ... E05B 47/0012; E05B 57/00; E05B 13/101; E05B 47/0649; E05B 47/0692; E05B 47/063; E05B 47/0673; E05B 81/04; E05B 81/08; E05B 15/00; E05B 63/04; E05B 47/0642; Y10T 70/55; Y10T 70/7062; Y10T 292/0962; Y10T 70/713; Y10T 70/7706
USPC ..... 70/277, 379 R, 380
See application file for complete search history.

(56) References Cited

U.S. PATENT DOCUMENTS

| | | | | |
|---|---|---|---|---|
| 3,404,549 | A * | 10/1968 | Best | E05B 9/04 70/370 |
| 5,791,177 | A * | 8/1998 | Bianco | E05B 17/0062 70/189 |
| 6,384,711 | B1 * | 5/2002 | Cregger | G07C 9/00103 340/5.65 |
| 6,427,505 | B2 * | 8/2002 | Imedio Ocana | E05B 47/0673 70/278.7 |
| 7,698,919 | B2 * | 4/2010 | Kim | E05B 47/0012 70/277 |
| 7,966,854 | B2 * | 6/2011 | Imedio Ocana | E05B 47/0642 192/69.62 |
| 7,997,108 | B2 * | 8/2011 | Flandrinck | E05B 17/04 70/379 R |
| 8,011,215 | B2 * | 9/2011 | Flandrinck | E05B 17/0058 70/379 R |
| 8,516,865 | B2 * | 8/2013 | Ferreira Sanchez | E05B 47/0012 70/223 |
| 2008/0229793 | A1 * | 9/2008 | Lange | E05B 47/0012 70/278.3 |
| 2010/0011822 | A1 * | 1/2010 | Imedio Ocana | E05B 47/0615 70/278.7 |
| 2010/0132420 | A1 * | 6/2010 | Flandrinck | E05B 17/0058 70/380 |

* cited by examiner

*Primary Examiner* — Suzanne Barrett
(74) *Attorney, Agent, or Firm* — Wenderoth, Lind & Ponack, L.L.P.

(57) ABSTRACT

A tab lock opening mechanism comprises at least a main rotor, a cylinder body with the main rotor passing through the cylinder body, a rotor supplement, a transmission cam, a tab with an internal face and an external face, and a nut, where the main rotor connects to the rotor supplement through an interior of the cylinder body, the transmission cam being placed coaxially to the rotor supplement, and the tab being placed coaxially to the transmission cam and transferring a rotation thereof to the tab by a transmitting pin.

13 Claims, 11 Drawing Sheets

TAB LOCK OPENING MECHANISM BY MEANS OF ELECTRONIC CLUTCH CYLINDERS

OBJECT OF THE INVENTION

The present invention relates to a tab lock opening mechanism by means of electronic clutch cylinders.

The invention is applicable to the industry of electronic locks, and to closures using tab locks.

TECHNICAL PROBLEM TO BE SOLVED AND BACKGROUND OF THE INVENTION

Tab locks, used in mailboxes, lockers, or closets, are usually mechanical, that is to say, they require the use of a key for its opening and closing.

Electronic cylinders that open the door in electronic locks are not used in this type of mechanical locks, given that the operation of these electronic cylinders is based on a rotor that rotates freely until its activation, when the rotor engages a drive cam which, after being engaged, rotates together with the rotor and opens the door. Said cam is free until the drive cam is engaged, which in those door locks where the cam is inside the door presents no problems, given that it cannot be easily manipulated from the outside.

The reason for not using electronic cylinder mechanisms in tab locks is that, in these locks, the cam is the tab itself, and this tab is easily accessible for its manipulation (by means of x-rays, for example); therefore, given that the tab is unlocked, manipulating the tab and opening the lock without a key would be very simple.

DESCRIPTION OF THE INVENTION

The invention discloses a tab lock opening mechanism by means of electronic clutch cylinders.

The tab lock opening mechanism by means of electronic clutch cylinders comprises at least a main rotor, a cylinder body, through which interior the main rotor passes, a rotor supplement, a transmission cam, a tab with an internal face and an external face, and a nut.

In the mechanism, the main rotor connects to the rotor supplement through the interior of the cylinder body, the transmission cam being placed coaxially to the rotor supplement, and the tab to the transmission cam, transferring its rotation to the tab by means of a transmitting pin.

In the tab lock opening mechanism by means of electronic clutch cylinders, the cylinder body comprises a housing, into which a spring and a dead bolt are introduced.

In the tab lock opening mechanism by means of electronic clutch cylinders, the rotor supplement comprises three parts:

- an external part, which comprises two recesses in which the rotor engages,
- a central part, which comprises two parallel walls, in which the tab and the transmission cam are installed, and
- an internal part, which comprises an elongated cylindrical shape, in which the nut is placed.

In the tab lock opening mechanism by means of electronic clutch cylinders, the transmission cam comprises an internal section and an external section.

The internal section has two parallel sides, which are placed in correspondence with the two parallel walls of the central part of the rotor supplement.

The external section is a doubly symmetric section (with respect to a vertical axis and a horizontal axis), which comprises two opposite circular sides that are part of a first circle with a first radius, and two lugs, which also oppose each other and are also circular, that are part of a second circle with a radius greater than radius of the first circle and are located between the two opposite circular sides.

The two lugs of the external section of the transmission cam are located in correspondence with two parallel sides of the internal section, and due to the shape of the internal section, the rotation of the rotor supplement makes the transmission cam to rotate.

In the tab lock opening mechanism by means of electronic clutch cylinders, the dead bolt comprises a body and a head.

In the tab lock opening mechanism by means of electronic clutch cylinders, the body has a cylindrical shape and the head in turn comprises a cylindrical interlocking tip, which has a diameter smaller than the body, and an unlocking ramp, the body and the head being a single piece.

In the tab lock opening mechanism by means of electronic clutch cylinders, the interlocking tip moves through the interior of the unlocking ramp.

In the tab lock opening mechanism by means of electronic clutch cylinders, the tab comprises the transmitting pin as an integral part of the tab itself, a single hole and at least two lateral indents.

In the mechanism object of the invention, the dead bolt fits in the single hole with the tab in a first position, or in one of the lateral indents with the tab in a position rotated by 90° with respect to the first position.

The transmitting pin of the tab lock opening mechanism by means of electronic clutch cylinders protrudes through the tab, both through the internal face and through the external face, in a perpendicular manner with respect to the two faces, such that installing the tab so it turns left or right by means of a 180° rotation with respect to a vertical axis of the tab itself is possible.

The procedure of operation of the tab lock opening mechanism by means of electronic clutch cylinders comprises the following steps:

- in the first moment, the rotor has not engaged the rotor supplement, this is why said rotor rotates freely, the tab being blocked because of the action of the dead bolt on the hole of the tab, axially charged by means of the spring;
- then the rotor engages the rotor supplement and the two rotate together, the transmission cam rotates with the rotation of the rotor supplement, pushing the head of the dead bolt and thereby releasing the load made by the dead bolt on the tab;
- the rotation of the transmission cam is transmitted to the tab through the transmitting pin, while the dead bolt is retracted;
- the tab completes its path by rotating 90° with respect to the initial position, moment when the dead bolt blocks again the tab in the lateral indent of said tab and the rotor disengages the rotor supplement;
- during the return of the tab, the transmission cam serves a dual function: first, unlocking the dead bolt, and then transmitting the rotation of the rotor to the tab, the rotor having previously engaged the rotor supplement.

In the procedure of operation of the tab lock opening mechanism by means of electronic clutch cylinders, the rotor rotates freely at the initial and final point, given that it disengaged the rotor supplement and the tab is blocked to any manipulation attempt.

In a second embodiment, the tab lock opening mechanism by means of electronic clutch cylinders comprises a drag cam, located between the transmission cam and the tab.

The drag cam of this second embodiment comprises a transmitting pin, a hole, at least two lateral indents, an external face, and an internal face.

In the second embodiment of the tab lock opening mechanism by means of electronic clutch cylinders, the drag cam is placed on the central part of the rotor supplement between the transmission cam and the tab, the drag cam is connected to the tab by means of the transmitting pin and receives the dead bolt in the hole.

In the second embodiment of the tab lock opening mechanism by means of electronic clutch cylinders, the tab comprises two holes and a hollow circular section, being the tab placed on the central part of the rotor supplement by means of said hollow circular section.

In the second embodiment of the tab lock opening mechanism by means of electronic clutch cylinders, the drag cam modifies the rotation of the tab to the left or to the right by means of a 180° rotation of said drag cam around a vertical axis, thereby inserting the transmitting pin in one of the holes of the tab.

A procedure of operation of the tab lock opening mechanism by means of electronic clutch cylinders according to the second embodiment comprises the following steps:

- in the first moment, the rotor has not engaged the rotor supplement, due to which said rotor rotates freely, the drag cam being blocked thanks to the action of the dead bolt on the hole of the drag cam, axially charged by means of the spring; therefore, the tab is also blocked;
- then the rotor engages the rotor supplement and the two rotate together, the transmission cam rotates with the rotation of the rotor supplement, pushing the head of the dead bolt and thereby releasing the load made by the dead bolt on the drag cam;
- the rotation of the transmission cam is transmitted to the tab through the drag cam by means of the transmitting pin, while the dead bolt is retracted;
- the tab completes its path by rotating 90° with respect to the initial position, moment when the dead bolt blocks the drag cam again in the lateral indent of said drag cam, the tab is blocked with the drag cam, and the rotor disengages the rotor supplement;
- during the return of the tab, the transmission cam serves a double function: first unlocking the dead bolt, and then transmitting the rotation of the rotor to the drag cam, which in turn transmits the rotation to the tab, the rotor having previously engaged the rotor supplement (4).

DESCRIPTION OF THE FIGURES

In order to complete the description and with the purpose of aiding a better comprehension of the characteristics of the invention, a set of figures representing the following in an illustrative rather than limitative manner accompany this specification as an integral part thereof.

The numerical references reflected in the figures correspond to the following elements:

1.—rotor,
2.—cylinder body,
3.—decorative washer,
4.—rotor supplement,
4*e*.—external part,
4*c*.—central part,
4*i*.—internal part,
4*p*.—parallel walls,
5.—spring,
6.—dead bolt,
6*a*.—body,
6*b*.—head,
6*c*.—unlocking ramp,
6*d*.—interlocking tip,
7.—housing,
8.—transmission cam,
8*i*.—internal section of the transmission cam,
8*e*.—external section of the transmission cam,
8*p*.—parallel sides of the internal section of the transmission cam,
9.—second fastening washer,
10.—drag cam,
11, 11'.—transmitting pin,
12.—regulating discs,
13.—fitting,
14, 14'—tab,
14*i*.—internal face of the tab,
14*e*.—external face of the tab,
15.—fastening nut,
16.—through hole,
17, 17'.—lateral indent,
18*c*, 18*l*.—hole,
19.—recess,
20*a*, 20*b*, 20*c*.—hollow circular section,
21.—flange,
100.—mechanism.

PREFERRED EMBODIMENT OF THE INVENTION

As indicated above, and as shown in the figures described above, the object of the invention is a tab (14, 14') lock opening mechanism (100) by means of electronic clutch cylinders.

Figure 1:
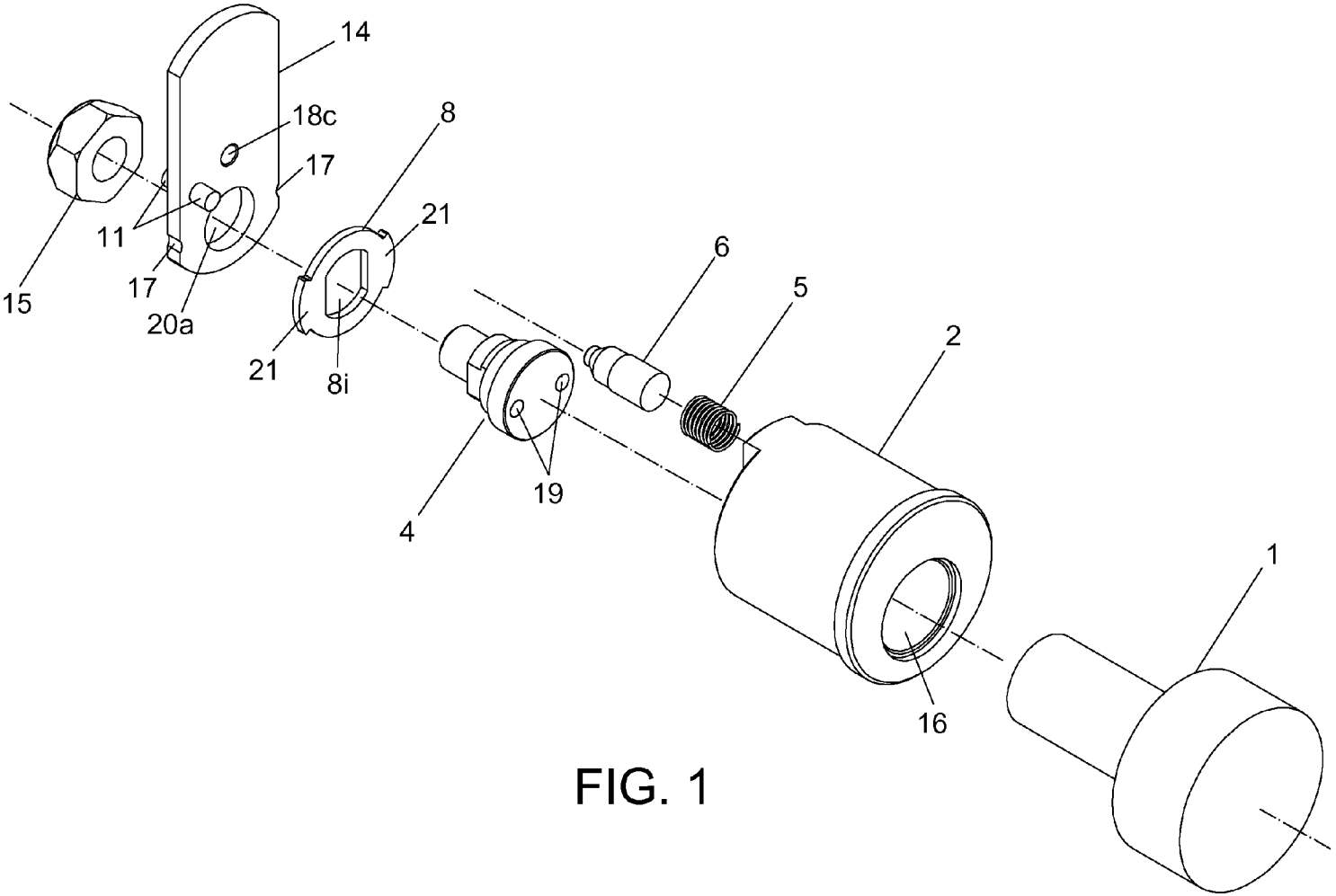
FIG. 1 shows an explosion view of a first embodiment of the invention.

In this description, the area of the mechanism (100) that may be manipulated by a user (right area of FIG. 1) is deemed to be the external area, and the area of the mechanism (100) that opens and closes the lock (area of the tab (14, 14') of the mechanism (100)) is deemed to be the internal area.

The invention has two different embodiments: a first simplified embodiment applicable to flat tabs (14), which may be adapted to close a door that opens to the left or to the right by means of the rotation of the tab (14) around itself, and a second embodiment, applicable to locks in which the mechanism cannot be adapted to the different rotations of doors by means of the rotation of the tab (14'). The foregoing usually takes place because the tab (14') in this second embodiment has a stepped shape, such that the step of the tab (14') prevents the free 180° rotation of the tab (14'), given that it cannot be inverted 180° to change the direction of the rotation.

Figure 2:
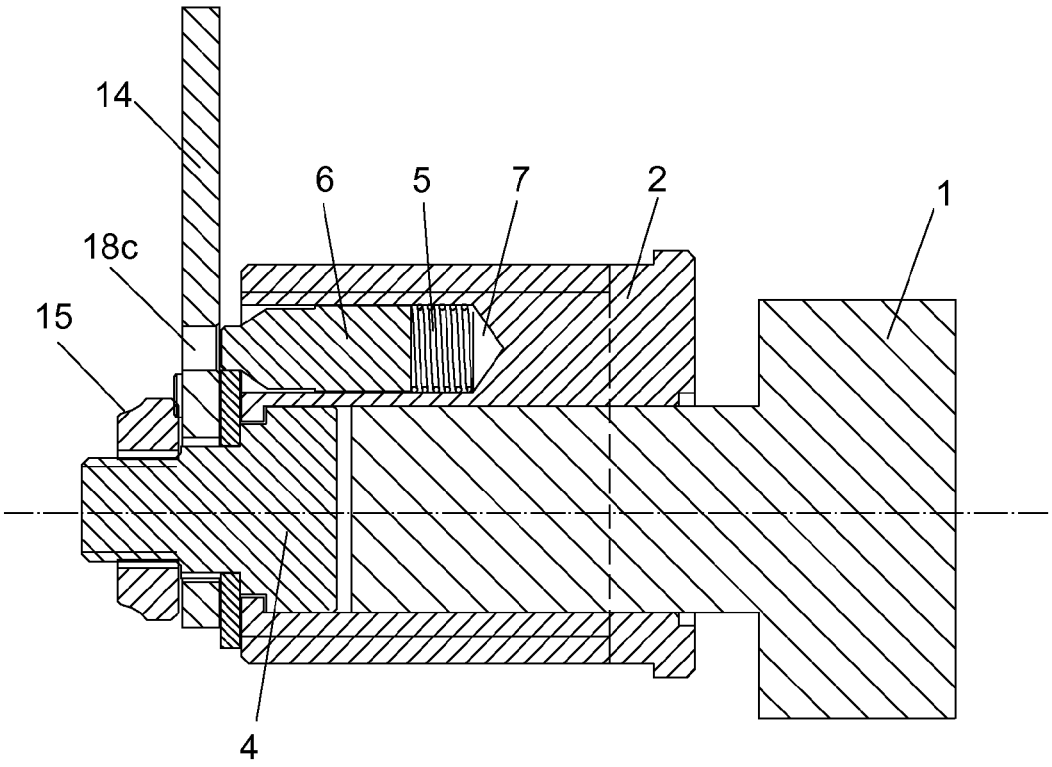
FIG. 2 shows a sectioned view of the first embodiment of the invention.

Hereinafter the first embodiment of the invention (shown in FIGS. 1 and 2), from the external area to the internal area, is described.

The lock opening mechanism (100) comprises a main rotor (1) of the mechanism (100) and a cylinder body (2), through which the main rotor (1) passes through the external area.

The cylinder body (2) comprises:

- a housing (7), into which a spring (5) and a dead bolt (6) are introduced,
- a through hole (16), through which the main rotor (1) is introduced.

Figure 8:
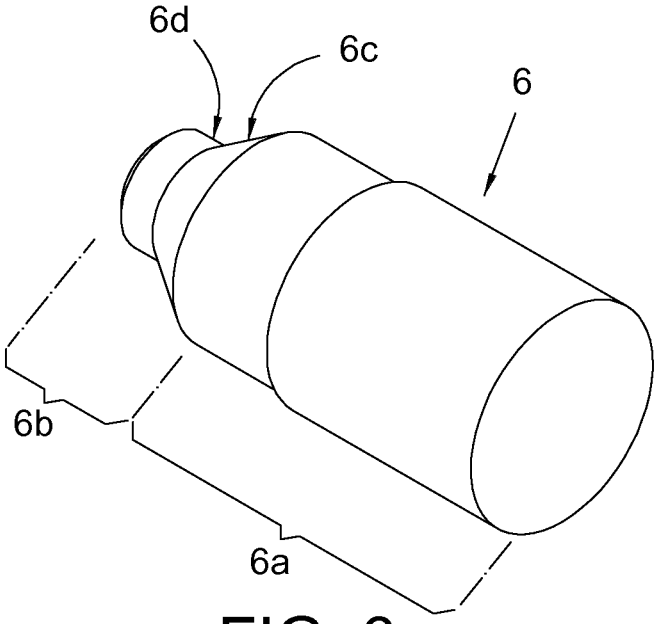
FIG. 8 shows a detailed view of the first embodiment of the dead bolt of the invention.
Figure 9:
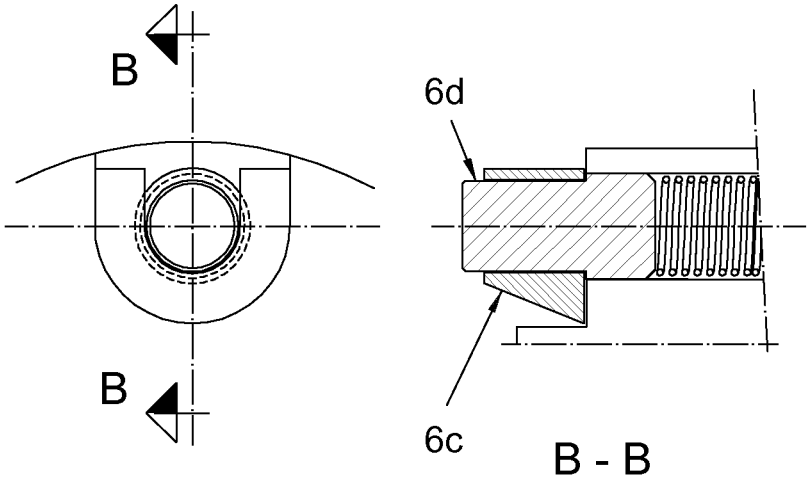
FIG. 9 shows a profile view and a sectioned view of the dead bolt of the invention according to the embodiment of FIG. 5.

The dead bolt (6) has two embodiments (shown in FIGS. 8 and 9). In the first embodiment of the dead bolt (6), said dead bolt (6) is a cylindrical piece that comprises a cylindrical body (6*a*) and a head (6*b*), which in turn comprises a cylindrical interlocking tip (6*d*), which has a smaller diameter than the body (6*a*), and an unlocking ramp (6*c*), the body (6*a*) and the head (6*b*) being a single piece; in an alternative embodiment of the dead bolt (6), the interlocking tip (6*d*) moves through the interior of the unlocking ramp (6*c*) (see details of the section in FIG. 9).

Figure 7:
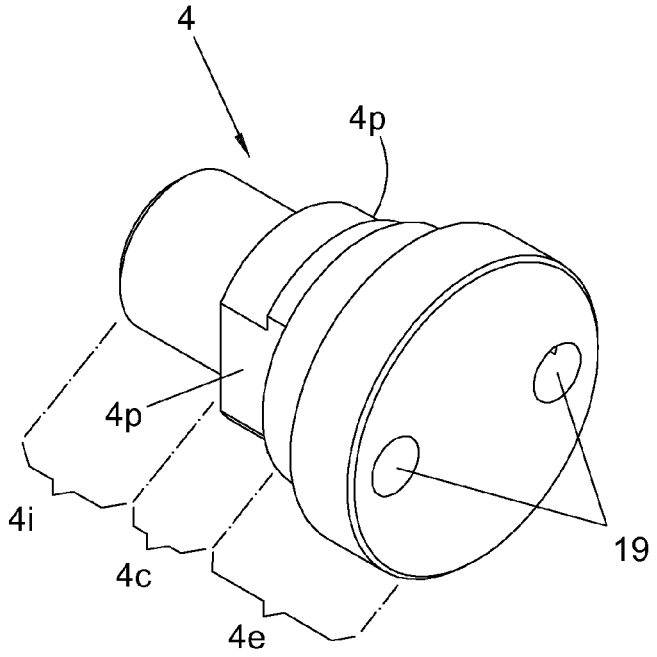
FIG. 7 shows a detailed view of the rotor supplement of the invention.

Next, continuing with the description from the external area to the internal area, the tab (14) lock opening mechanism (100) by means of electronic clutch cylinders comprises a rotor supplement (4) (shown in FIG. 7), the rotor (1) engages the rotor supplement (4) through one of its sides, and, on the other side, a nut affixing the opening mechanism (100) to the door where it is installed is placed.

The rotor supplement (4) comprises three parts: a first external part (4*e*), comprising two recesses (19) with which the rotor engages (1), a central part (4*c*) with two parallel walls (4*p*) and an internal part (4*i*), with an elongated cylindrical shape.

Figure 6:
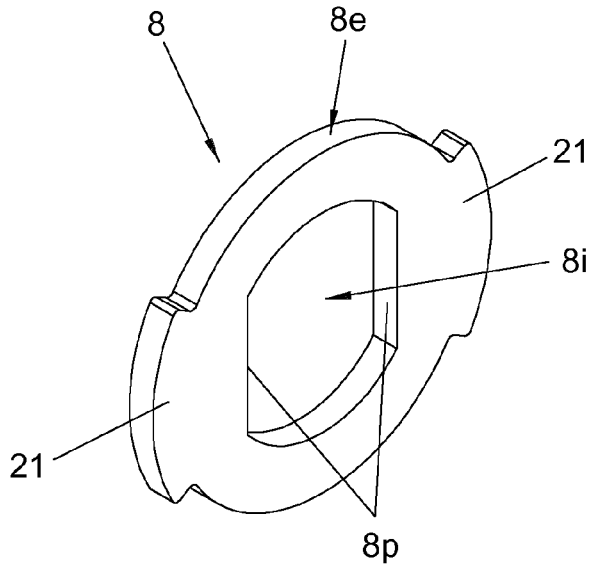
FIG. 6 shows a detailed view of the transmission cam of the invention.

The mechanism (100) comprises a transmission cam (8) (shown in FIG. 6), which is located in the central part (4*c*) of the rotor supplement (4). Said transmission cam (8) comprises an internal section (8*i*) having two parallel sides (8*p*) which are placed in correspondence with the two parallel walls (4*p*) of the central part (4*c*) of the rotor supplement (4), this is why the rotation of the rotor supplement (4) causes the rotation of said transmission cam (8).

The external section (8*e*) of the transmission cam (8) is a doubly symmetric section (with respect to a vertical axis and a horizontal axis), which comprises two opposite circular sides that are part of a first circle with a first radius, and two lugs (21), which also oppose each other and are also circular, that are part of a second circle with a radius greater than the radius of the first circle and are located between the two opposite circular sides. The two lugs (21) of the external section (8*e*) of the transmission cam (8) correspond with the two parallel sides (8*p*) of the internal section (8*i*).

Figure 10:
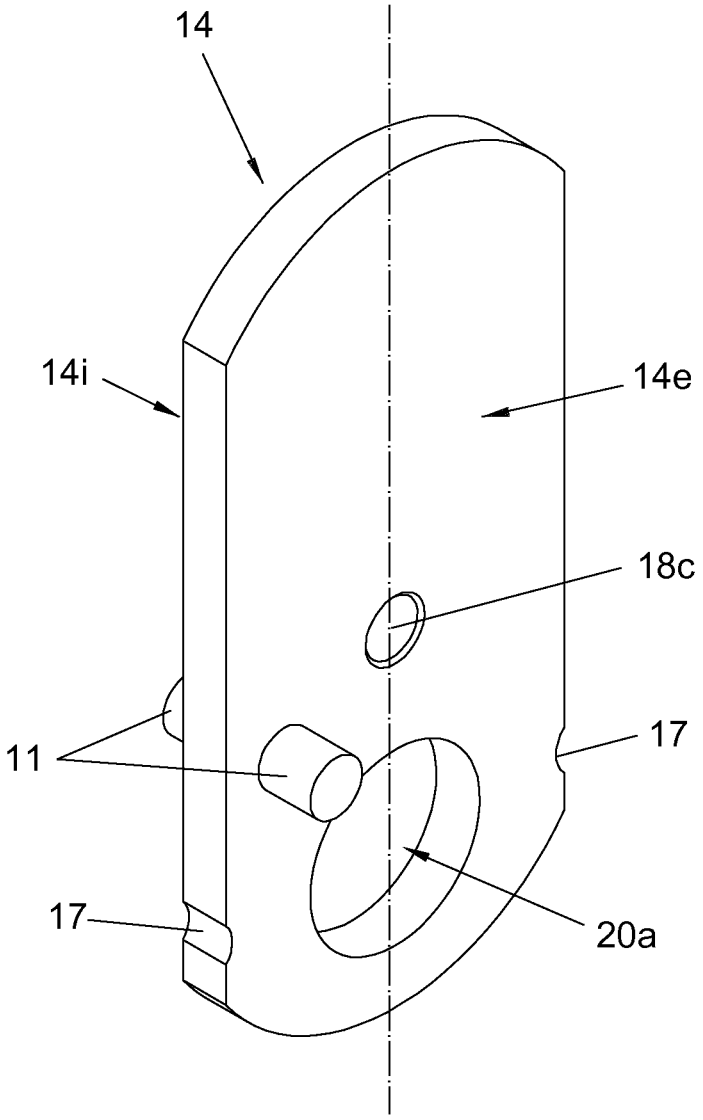
FIG. 10 shows a detailed view of the tab according to the first embodiment of the invention.

Next, the tab (14) is placed on the central part (4*c*) of the rotor supplement (4) (shown in FIG. 10), said tab (14) comprises a hollow circular section (20*a*), with the central part (4*c*) of the rotor supplement (4) passing through said hollow circular section (20*a*). Finally a nut (15) that holds the elements of the mechanism (100) is placed in the internal part (4*i*) of the rotor supplement (4), In this first embodiment, the tab (14) comprises a through hole (18*c*), into which the head (6*b*) of the dead bolt (6) fits, when said dead bolt (6) is blocking the tab (14). The tab (14) comprises two lateral indents (17), located in the perimeter of the tab (14) at the height of the hollow circular section (20*a*). The tab (14) comprises an external face (14*e*) and an internal face (14*i*), opposed to each another.

Likewise, in this first embodiment, the tab (14) comprises a transmitting pin (11), which is a cylindrical protrusion perpendicular to the tab (14), said transmitting pin (11) protruding through the two faces (14*e*, 14*i*) of the tab (14).

The transmitting pin (11) protruding through the two faces (14*e*, 14*i*) of the tab (14), along with the through hole (18*c*), and the shape of the external section (8*e*) of the transmission cam (8), allow adapting the mechanism (100) to close a door to the right or to the left by means of a 180° rotation with respect to a vertical axis of the tab.

Figure 14:
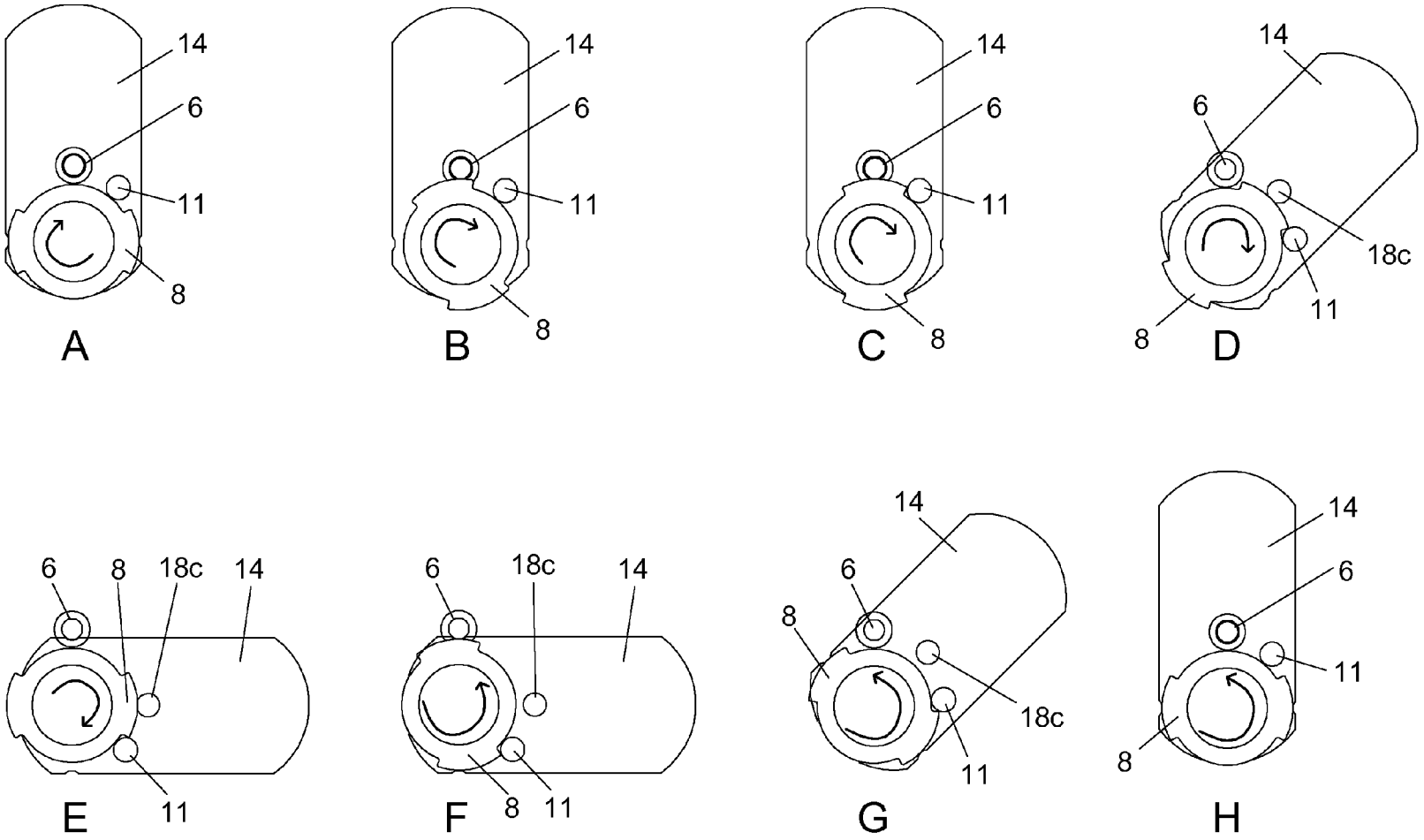
FIG. 14 shows a sequence of the operation of the mechanism object of the invention according to the first embodiment.

The operation of the mechanism (100) according to the first embodiment is exposed below, based on FIG. 14:

1. In the first moment, the rotor (1) is not engaged to the rotor supplement (4), which means that said rotor (1) rotates freely, the tab (14) being blocked because of the action of the dead bolt (6), axially charged by means of the spring (5), on the hole (18*c*) of the tab (14).
2. Then the rotor (1) engages the rotor supplement (4) and the two rotate together, the transmission cam (8) rotates together with the rotation of the rotor supplement (4), thus releasing the load made by the dead bolt (6) on the tab (14).
3. The rotation of the transmission cam (8) is transmitted to the tab (14) through the transmitting pin (11); at this point, the dead bolt (6) is retracted.
4. The tab (14) completes its path by rotating 90° with respect to the initial position, moment when the dead bolt (6) blocks again the tab (14) in the lateral indent (17) of said tab (14) (as shown in FIG. 14E). At this moment the rotor (1) disengages the rotor supplement (4).
5. Similarly, in the return of the tab (14), the transmission cam (8) serves a dual function: first unlocking the dead bolt (6) and then transmitting the rotation of the rotor (1) to the tab (14), the rotor (1) having previously engaged the rotor supplement (4).
6. Final and initial resting point at 0°. At this point, the rotor (1) rotates freely (given that it has disengaged the rotor supplement (4)) and the tab (14) is blocked to any manipulation attempt.

The second embodiment of the mechanism (100) (shown in FIGS. 3 and 4), comprises a few additional elements.

Figure 12:
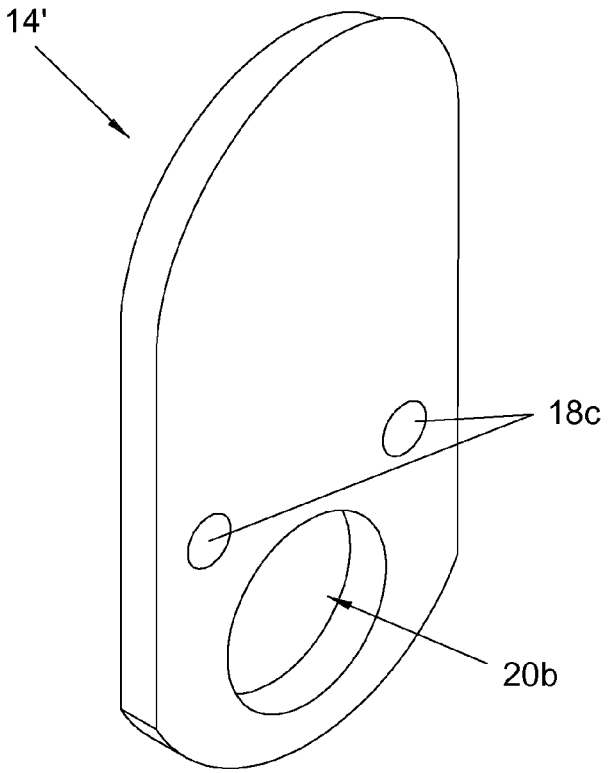
FIG. 12 shows a detailed view of the tab according to the second embodiment of the invention.

In the second embodiment, the tab (14') (shown in FIG. 12) comprises, just like in the first embodiment, two through holes (18*c*) and a hollow circular section (20*b*) with the internal part (4*i*) of the rotor supplement (4) passing through said hollow circular section (20*b*).

Figure 13:
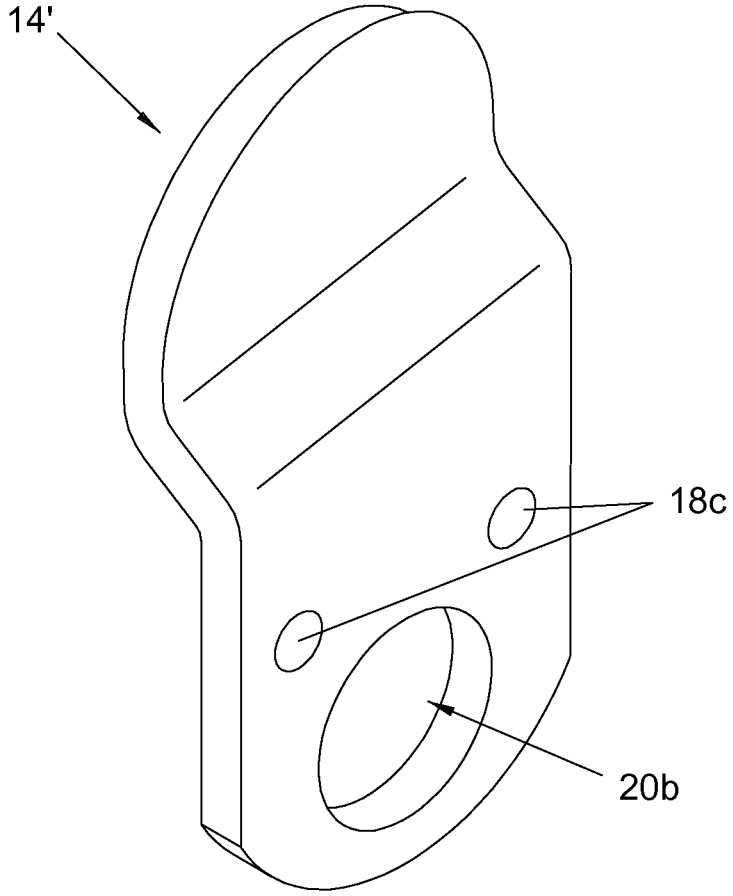
FIG. 13 shows a detailed view of an alternative embodiment of the tab according to the second embodiment of the invention.

FIG. 13 shows an alternative embodiment of the tab (14') of the second embodiment of the invention, which is a tab (14') with a stepped shape.

Figure 11:
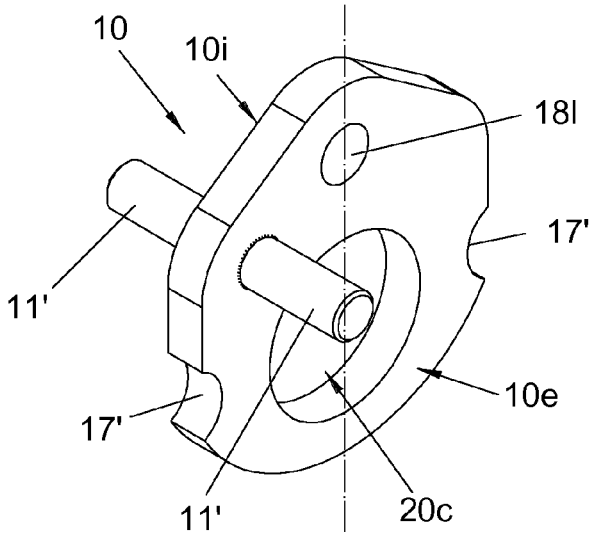
FIG. 11 shows a detailed view of the drag cam of the second embodiment of the invention.

The second embodiment also comprises, in addition to all of the components of the first embodiment, a drag cam (10) (shown in FIG. 11), which is placed between the transmission cam (8) and the tab (14').

A second fastening washer (9) is placed between the drag cam (10) and the transmission cam (8).

The drag cam (10) comprises the following:

a hollow circular section (20*c*), though which the internal part (4*i*) of the rotor supplement (4) passes, a transmitting pin (11'), which is a cylindrical body that protrudes perpendicularly to the drag cam (10) and is connected to one of the through holes (18*c*) of the tab (14'), a through hole (18*l*) that receives the head (6*b*) of the dead bolt (6), two lateral indents (17'), located at the height of the hollow circular section (20*c*).

Likewise, the mechanism (100) comprises a decorative washer (3), located around the cylinder body (2).

The transmitting pin (11') protrudes beyond one side of the drag cam (10) or beyond the opposite side, such that by means of the 180° rotation of the drag cam (10) with respect to a vertical axis, the mechanism (100) can be adapted to doors that open to the right or to the left.

Figure 3:
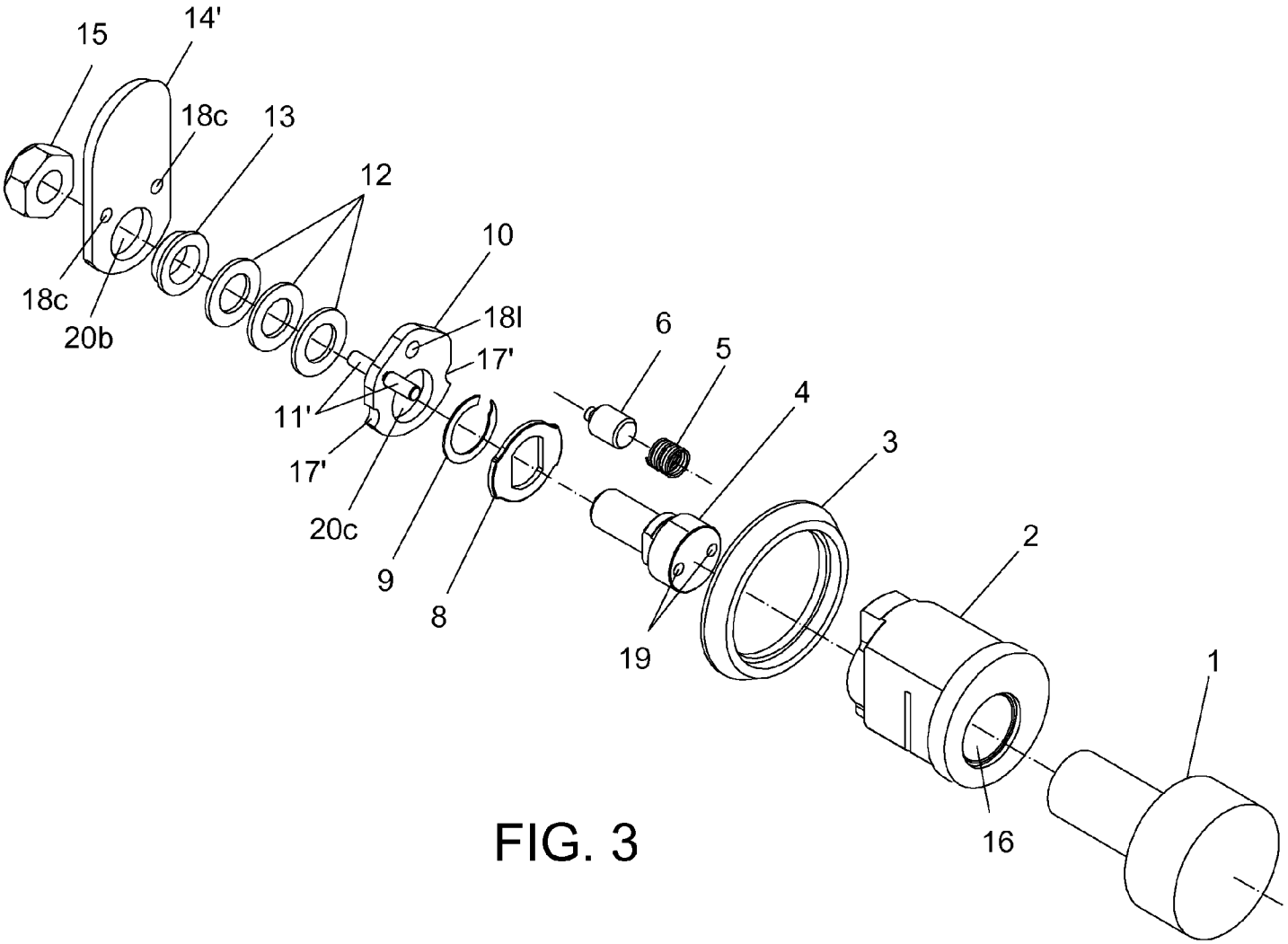
FIG. 3 shows an explosion view of a second embodiment of the invention.
Figure 4:
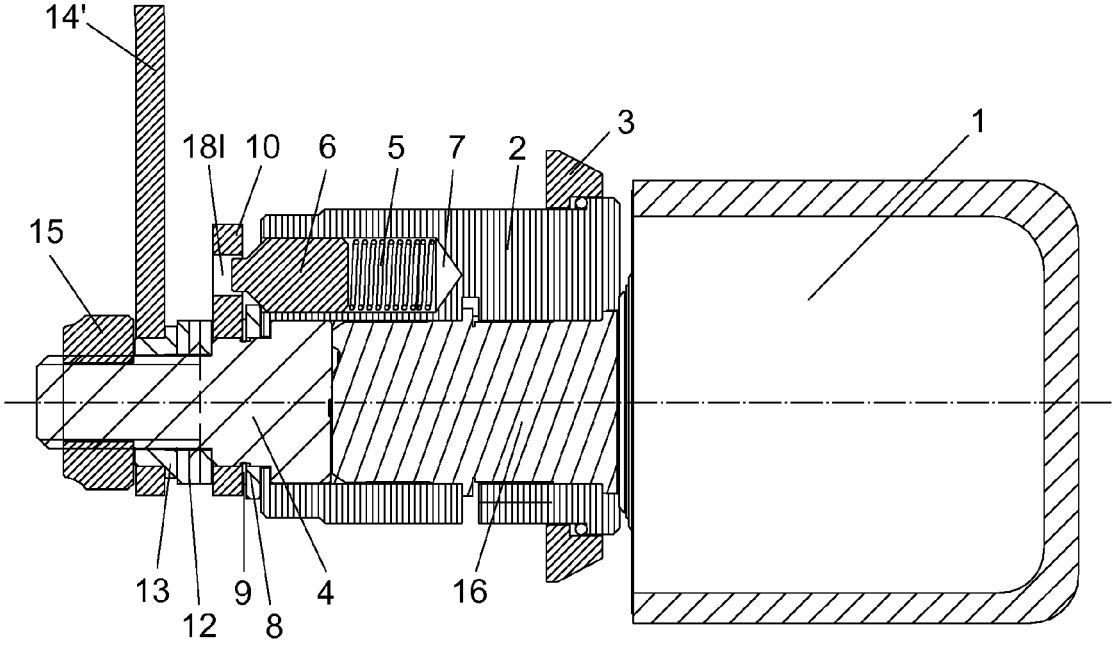
FIG. 4 shows a sectioned view of the second embodiment of the invention.
Figure 5:
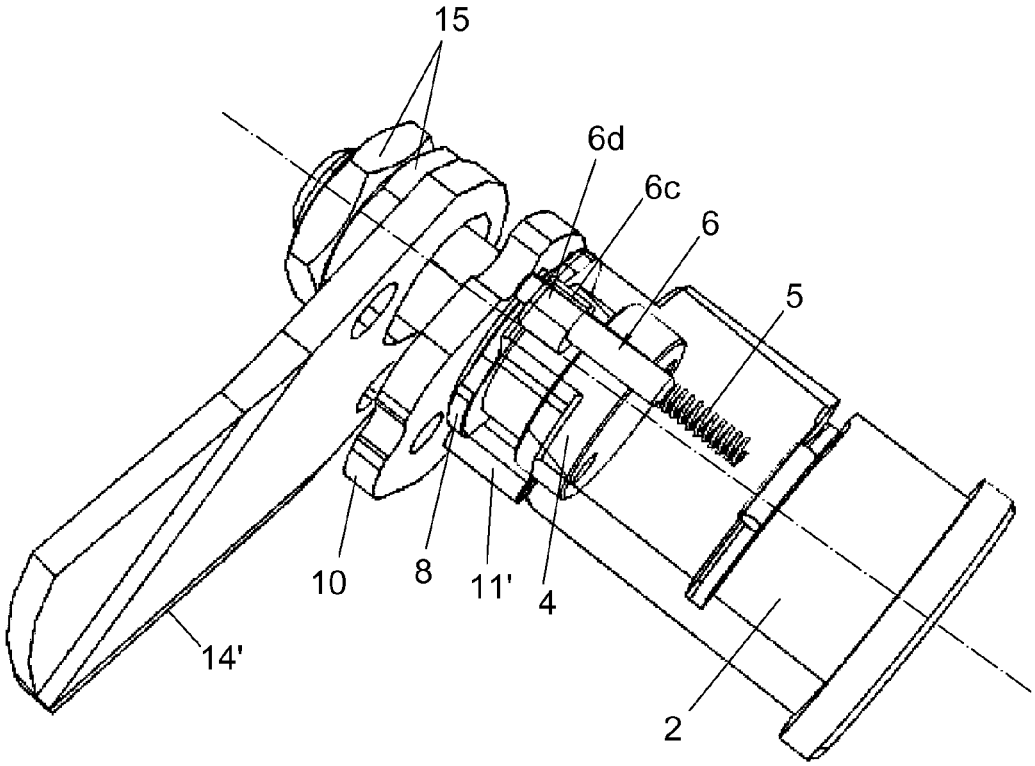
FIG. 5 shows a perspective view of the second embodiment of the invention with the dead bolt according to an alternative embodiment.

In the second embodiment, regulating discs (12) and a fitting (13) located between the tab (14') and the regulating discs (12) are provided after the drag cam (10) (these elements can all be observed in FIG. 3).

The regulating discs (12) are used to regulate the tab (14') according to the necessary depth, such that the tab (14') rotates and enters into contact against the wall of the mailbox/closet after the mechanism (100) has been installed. The fitting (13) facilitates the rotation of the tab (14').

Finally, the second embodiment of the mechanism (100) comprises at least a nut (15), affixed to the internal part (4*i*) of the rotor supplement (4), thereby affixing all of the elements that are part of the tab (14') lock opening mechanism (100) by means of electronic clutch cylinders.

The operation of the mechanism (100) according to the second embodiment is exposed below:

1. In the first moment, the rotor (1) has not engaged the rotor supplement (4), due to which said rotor (1) rotates freely. The tab (14') is blocked thanks to the action of the transmitting pin (11') of the drag cam (10) and the dead bolt (6) blocking the drag cam (10), by being axially charged by means of the spring (5) on the hole (18*i*) of the drag cam (10).
2. Then the rotor (1) engages the rotor supplement (4) and the two rotate together, the transmission cam (8) rotates with the rotation of the rotor supplement (4), releasing the load made by the dead bolt (6) on the drag cam (10).
3. The rotation of the transmission cam (8) is transmitted to the drag cam (10) and from the drag cam (10) to the tab (14') by means of the transmitting pin (11'); the dead bolt (6) is retracted at this point.
4. The tab (14') completes its path by rotating 90° and entering into contact against the two faces of the body (2) with respect to the initial position, which is when the dead bolt (6) blocks the drag cam (10) once again in the lateral indent (17) of said drag cam (10), and the tab (14') is blocked with the blocking of the drag cam (10). The rotor (1) disengages the rotor supplement (4) at that time.
5. Similarly, in the return of the tab (14'), the transmission cam (8) serves a dual function: first, unlocking the dead bolt (6) and then transmitting the rotation of the rotor (1) to the drag cam (10), the rotor (1) having previously engaged the rotor supplement (4).
6. Final and initial resting point at 0°. At this point, the rotor (1) rotates freely (given that it has disengaged the rotor supplement (4)) and the tab (14) is blocked to any manipulation attempt.

The invention should not be limited to the particular embodiment described in this document. Experts in the art may develop other embodiments based on the description made herein. Therefore, the scope of the invention is defined by the following claims.

The invention claimed is:

1. A tab lock opening mechanism by electronic clutch cylinders, comprising:

a main rotor, a cylinder body configured such that the main rotor passes through the cylinder body, a rotor supplement, a transmission cam, a tab, and a nut, wherein:

the main rotor connects to the rotor supplement through an interior of the cylinder body, the transmission cam is placed coaxially to the rotor supplement and the tab is placed coaxially to the transmission cam, transferring a rotation thereof to the tab by a transmitting pin, the cylinder body comprises a housing, into which a spring and a dead bolt are introduced, and a rotation stopper in the cylinder body, and the rotor supplement comprises three parts:

an external part, which comprises two recesses in which the main rotor engages, a central part, which comprises two parallel walls, in which the tab and the transmission cam are installed, and an internal part, which comprises an elongated cylindrical shape, in which at least the nut and at least a supplement ring are placed.

2. The tab lock opening mechanism by electronic clutch cylinders according to claim 1, wherein the transmission cam comprises an internal section and an external section, such that:

the internal section has two parallel sides, which are placed in correspondence with the two parallel walls of the central part of the rotor supplement, the external section is a doubly symmetric section, which comprises two opposite circular sides that are part of a first circle with a first radius, and two lugs, which oppose each other and are circular, that are part of a second circle with a radius greater than the first radius of the first circle and are located between the two opposite circular sides, the two lugs of the external section of the transmission cam being located in correspondence with the two parallel sides of the internal section, and due to the shape of the internal section, a rotation of the rotor supplement makes the transmission cam rotate.

3. The tab lock opening mechanism by electronic clutch cylinders according to claim 1, wherein the dead bolt comprises a body and a head.

4. The tab lock opening mechanism by electronic clutch cylinders according to claim 3, wherein the body of the dead bolt has a cylindrical shape and the head of the dead bolt in turn comprises a cylindrical interlocking tip, which has a smaller diameter than the body of the dead bolt, and an unlocking ramp, the body of the dead bolt and the head of the dead bolt being a single piece.

5. The tab lock opening mechanism by electronic clutch cylinders according to claim 4, wherein the head of the dead bolt is divided into the cylindrical interlocking tip and the unlocking ramp, the cylindrical interlocking tip moving through an interior of the unlocking ramp and being connected to the spring on one side.

6. The tab lock opening mechanism by electronic clutch cylinders according to claim 1, wherein the tab comprises:

an internal face and an external face, the transmitting pin as an integral part of the tab itself, a single hole, at least two lateral indents, and a hollow circular section, such that the dead bolt fits:

a) in the single hole, with the tab in a first position, or b) in one of the at least two lateral indents, with the tab in a second position rotated by 90° with respect to the first position.

7. The tab lock opening mechanism by electronic clutch cylinders according to claim 6, wherein the transmitting pin protrudes beyond the tab, perpendicularly with respect to the internal face and the external face, such that installing the tab to turn left or to turn right is possible by a 180° rotation of the tab with respect to a vertical axis of the tab.

8. A procedure of operation of the tab lock opening mechanism by electronic clutch cylinders according to claim 1, the procedure comprising:

a. in a first moment, the main rotor not engaging with the rotor supplement, such that the main rotor rotates freely, the tab being blocked because of an action of the dead bolt, and being axially charged by the spring, on a hole of the tab;

b. then the main rotor engaging the rotor supplement and the main rotor and the rotor supplement rotating together, the transmission cam rotating together with a rotation of the rotor supplement, pushing a head of the dead bolt through an unlocking ramp of the dead bolt and releasing a load made by the dead bolt on the tab;

c. the rotation of the transmission cam being transmitted to the tab through the transmitting pin; at which point, the dead bolt is still retracted, d. the tab completing a path thereof by rotating 90° with respect to an initial position, at a moment when the dead bolt blocks the tab again in a lateral indent of the tab, and disengaging the main rotor of the rotor supplement at this time, and e. in a return of the tab, the transmission cam serving a dual function: first, unlocking the dead bolt and then transmitting a rotation of the main rotor to the tab, the main rotor having previously engaged the rotor supplement.

9. The procedure of operation of the tab lock opening mechanism by electronic clutch cylinders according to claim 8, wherein, at a final and initial resting point, the main rotor rotates freely, given that the main rotor is disengaged of the rotor supplement and the tab is blocked to any manipulation attempt by the dead bolt.

10. The tab lock opening mechanism by electronic clutch cylinders according to claim 1, further comprising a drag cam located between the transmission cam and the tab, the drag cam comprising:

a transmitting pin, a hole, at least two lateral indents, an external face, a hollow circular section, and an internal face, such that the drag cam is placed on a central part of the rotor supplement between the transmission cam and the tab, the drag cam being connected to the tab by the transmitting pin of the drag cam, and receiving the dead bolt in the hole.

11. The tab lock opening mechanism by electronic clutch cylinders according to claim 10, wherein the tab comprises:

two holes, and a hollow circular section, such that the tab is placed on the central part of the rotor supplement by the hollow circular section.

12. The tab lock opening mechanism by electronic clutch cylinders according to claim 10, wherein the tab modifies a rotation thereof to a left side or to a right side by a 180° rotation of the drag cam around a vertical axis, thereby inserting the transmitting pin of the drag cam in one of two holes of the tab.

13. A procedure of operation of the tab lock opening mechanism by electronic clutch cylinders according to claim 1, the procedure comprising:

a. in a first moment, the main rotor not engaging with the rotor supplement, such that the main rotor rotates freely, a drag cam being blocked because of an action of the dead bolt, and being axially charged by the spring, on a hole of the drag cam so as to also block the tab;

b. then the main rotor engaging the rotor supplement and the main rotor and the rotor supplement rotating together, the transmission cam rotating together with a rotation of the rotor supplement, pushing a head of the dead bolt through an unlocking ramp of the dead bolt, thereby releasing a load made by the dead bolt on the drag cam;

c. the rotation of the transmission cam being transmitted to the tab through the drag cam by the transmitting pin; at which point the dead bolt is retracted;

d. the tab completing a path thereof by rotating 90° with respect to an initial position, at a moment when the dead bolt blocks the drag cam again in a lateral indent of the drag cam, and the tab is blocked with the blocking of the drag cam, and disengaging the main rotor of the rotor supplement at this time, and e. in a return of the tab, the transmission cam serving a dual function: first unlocking the dead bolt and then transmitting a rotation of the main rotor to the drag cam, which in turn transmits the rotation of the main rotor to the tab, the main rotor having previously engaged the rotor supplement.

* * * * *